US008783495B2

(12) United States Patent
Forrest

(10) Patent No.: US 8,783,495 B2
(45) Date of Patent: Jul. 22, 2014

(54) CAN END

(75) Inventor: Randall G. Forrest, Park Ridge, IL (US)

(73) Assignee: Rexam Beverage Can Company, Chicago, IL (US)

( * ) Notice: Subject to any disclaimer, the term of this patent is extended or adjusted under 35 U.S.C. 154(b) by 118 days.

(21) Appl. No.: 13/026,599

(22) Filed: Feb. 14, 2011

(65) Prior Publication Data

US 2012/0205378 A1 Aug. 16, 2012

(51) Int. Cl.
*B65D 17/34* (2006.01)
*B65D 17/00* (2006.01)

(52) U.S. Cl.
CPC ..... *B65D 17/24* (2013.01); *B65D 2517/0014* (2013.01); *B65D 2517/0062* (2013.01); *B65D 2517/0016* (2013.01)
USPC ..... 220/269; 220/619; 220/623

(58) Field of Classification Search
CPC ..... B65D 2517/0014; B65D 2517/0062; B65D 2517/0016; B65D 17/24
USPC ..... 220/269, 619, 623
See application file for complete search history.

(56) References Cited

U.S. PATENT DOCUMENTS 3,941,277 A * 3/1976 McKinney et al. ..... 220/273
3,967,752 A * 7/1976 Cudzik ..... 220/269
4,084,721 A 4/1978 Perry
4,210,257 A 7/1980 Radtke
4,372,462 A 2/1983 Dassler et al.
5,375,729 A * 12/1994 Schubert ..... 220/271
5,715,964 A 2/1998 Turner et al.
5,964,366 A 10/1999 Hurst et al.
6,161,717 A 12/2000 Forrest et al.
6,164,480 A * 12/2000 Heinicke et al. ..... 220/269
6,330,954 B1 * 12/2001 Turner et al. ..... 220/269
6,460,723 B2 * 10/2002 Nguyen et al. ..... 220/619
6,575,684 B2 6/2003 Heinicke et al.

(Continued)

FOREIGN PATENT DOCUMENTS

WO 0058161 A1 10/2000
WO 02051710 A1 7/2002

OTHER PUBLICATIONS

International Search Report mailed May 10, 2012 from the European Patent Office acting as International Searching Authority in Application No. PCT/US2012/024969 owned by Rexam Beverage Can Company.

*Primary Examiner* — Andrew Perreault
*Assistant Examiner* — James M Van Buskirk
(74) *Attorney, Agent, or Firm* — Ungaretti & Harris LLP

(57) ABSTRACT

A can end for a beverage container has a circumferential curl positioned about a longitudinal axis, a wall extending downwardly from the curl, a strengthening member joined to the wall, and a center panel joined to the strengthening member and extending radially inwardly relative to longitudinal axis. A rivet is located at a center position of the center panel. A frangible score has terminal ends located on a common side of the rivet. The terminal ends are separated by a non-frangible hinge segment. A displaceable tear panel is defined by the frangible score and the non-frangible hinge segment. A non-detachable tab has a nose and a lift end. The nose overlies a portion of the displaceable tear panel. A deboss groove is located on the public side of the center panel and extends downwardly in a direction towards the product side. The deboss groove is located adjacent the score line.

15 Claims, 5 Drawing Sheets

(56) References Cited

U.S. PATENT DOCUMENTS

| | | | | |
|---|---|---|---|---|
| 6,715,629 | B2 | 4/2004 | Hartman et al. | |
| 6,761,281 | B2 | 7/2004 | Hartman | |
| 7,000,797 | B2 * | 2/2006 | Forrest et al. | 220/269 |
| 2001/0002671 | A1 | 6/2001 | Heinicke et al. | |
| 2002/0113069 | A1 | 8/2002 | Forrest et al. | |
| 2003/0080132 | A1 | 5/2003 | Forrest et al. | |
| 2003/0111469 | A1 | 6/2003 | Hartman et al. | |
| 2004/0099664 | A1 | 5/2004 | Hartman | |

* cited by examiner

CAN END

CROSS-REFERENCE TO RELATED APPLICATIONS

N/A

FEDERALLY SPONSORED RESEARCH OR DEVELOPMENT

N/A

TECHNICAL FIELD

The invention relates to beverage cans. More particularly, the invention relates to a can end or lid having a displaceable tear panel with a deboss groove adjacent a score line and generally following the contour thereof.

BACKGROUND OF THE INVENTION

Typical end closures for beer and beverage containers have an opening panel and an attached leverage tab for pushing the opening panel into the container to open the end. The container is typically a drawn and ironed metal can, usually constructed from a thin plate of aluminum or steel. End closures for such containers are also typically constructed from a cutedge of thin plate of aluminum, formed into a blank end, and manufactured into a finished end by a process often referred to as end conversion. These ends are formed in the process of first forming a cutedge of thin metal, forming a blank end from the cutedge, and converting the blank into an end closure which may be seamed onto a container.

These types of container ends have been used for many years, with almost all such ends in use today being the "ecology" or "stay-on-tab" ("SOT") ends in which the tab remains attached to the end after a tear panel, including large-opening ends ("LOE"), is opened. The tear panel being a portion of the can end defined by a primary score line or length. The tear panel may be opened, that is the score may be severed, and the tear panel displaced at an angular orientation relative to the remaining portion of the can end. The tear panel remains hingedly connected to the remaining portion of the can end by a hinge segment, leaving an opening through which the user draws the contents of the container. In an LOE, the opening is typically at least 0.5 square inches in area, but in more recently developed ends, LOE-type openings have had areas less than 0.5 square inches.

It is also well known to provide a secondary score line of lesser depth than the primary score line. This score line, commonly referred to as an "antifracture score" is provided to reduce residual stresses associated with the primary score line so as to prevent or minimize the occurrence of microcracks in, or premature fracture along, the primary score line.

Opening of the tear panel is operated by the tab which is attached to the can end by a rivet. The tab is attached to the can end such that a nose of the tab extends over a proximal portion of the tear panel. A lift end of the tab is located opposite the tab nose and provides access for a user to lift the lift end, such as with the user's finger, to force the nose against the proximal portion of the tear panel.

When the tab nose is forced against the tear panel, the score initially ruptures at a vent region of the score. This initial rupture of the score is primarily caused by the lifting force on the tab resulting in lifting of a central region of the can end, immediately adjacent the rivet. As the tab is lifted further, the score rupture propagates along the length of the score, eventually stopping at the hinge segment.

To improve openability of the can end, manufacturers first designed tear panels with circumferential emboss beads to stiffen the tear panel. However, tear panels having an emboss bead have a tendency to dome or bulge when the beverage container is pressurized. Thus, the tear panel must be pushed back through the pour open upon opening. This required an increased amount of pressure to snap the tear panel through the pour opening. When beverage can manufacturers began producing can ends with larger pour openings, and consequently larger tear panels, this increase in required opening force became an issue or problem. These LOEs have a greater tendency to bulge due to their much greater surface area.

The circumferential emboss bead generally gave way to a down panel on the center portion of the tear panel to further improve openability. The down panel was developed to lower the magnitude of the force required to open the tear panel, especially on LOEs. The down panel generally does not bulge. This keeps the score flat. When the score is flat, the pour panel does not have to pass back though the pour opening as the can end is opened. The down panel produced a concave effect upon initial opening. This allowed score on LOE's to shear easier or with less force.

However, prior to pressurization, LOEs have a tendency to exhibit an upward dome. This causes a nose portion of the tab to ride a little high. When the LOEs are stacked, this high riding tab nose causes sponginess in the can end stacking. This sponginess can lead to miscounts of ends in a sleeve of stacked ends or can lead to longer sleeves than if the sponginess did not occur. For example, 4 to 5 inch differences in bag or sleeve length from one sleeve to the next can be experienced based on the sponginess of the stack.

Additionally, the contact between the tab and the product side of the adjacent, or next stacked, can end may encourage manufacturers to produce tabs with less height and less perfectly formed curved edges. Such tabs may have less height, but also has less strength for opening the can end.

The present invention is provided to solve the problems discussed above and other problems, and to provide advantages and aspects not provided by prior can ends of this type. A full discussion of the features and advantages of the present invention is deferred to the following detailed description, which proceeds with reference to the accompanying drawings.

SUMMARY OF THE INVENTION

The invention is directed to a can end for a beverage container. The can end comprises: a circumferential curl positioned about a longitudinal axis; a wall extending downwardly from the curl; a strengthening member joined to the wall; and a center panel joined to the strengthening member and extending radially inwardly from the strengthening member relative to the longitudinal axis. The center panel comprises: a product side; a public side; a rivet; a score line comprising a frangible score having terminal ends located on a common side of the rivet, the terminal ends separated by a non-frangible hinge segment; a displaceable tear panel in the center panel at least substantially defined by the frangible score and the non-frangible hinge segment; a non-detachable tab having a nose and a lift end wherein the nose overlays a portion of the displaceable tear panel; and a deboss groove in the public side extending in a direction towards the product side and located adjacent the score line.

The can end may include one or more of the following features, alone or in any reasonable combination. The deboss groove may be located radially inwardly from the score line. The deboss groove may follow a contour of the score line. The deboss groove may be non-circumferential. The deboss groove may be interrupted by a portion of the center panel located adjacent the non-frangible hinge segment. The can end may further comprise a down-panel in the displaceable tear panel wherein the deboss groove is located between the score line and the down panel. The displaceable tear panel may have a surface area greater than 0.5 $in^2$ on 202-sized can ends and less than 0.5 $in^2$ on smaller ends. A distance between opposing sides of the deboss groove from a nine o'clock to a three o'clock position on the displaceable tear panel, using a clock-like orientation wherein a center of the clock-like orientation is defined by a central axis extending through the rivet which is perpendicular to a transverse axis extending through a widest segment of the displaceable tear panel and wherein a segment of the central axis defines a 12 o'clock to 6 o'clock distance, may be greater than a distance between opposing edges of the non-detachable tab taken along a line transecting the rivet and parallel to the transverse axis. The can end may further comprise an anti-fracture score located radially inwardly of the frangible. The deboss groove may be located less than 7 mm from the score line, less than 6 mm from the from the score line, less than 3 mm from the score line, or less than 1 mm from the score line, or range or combination of ranges therein. The tab may overlie a portion of the deboss groove near the rivet. The tab may overlie the deboss groove from a position on the tear panel just short of the 12 o'clock position to slightly greater than the 1 o'clock position. The groove may form a narrow channel wherein the narrow channel may have a U-shaped cross-section. The groove may have a depth approximately equal to the depth of the frangible score. An opening of the groove may have a width no more than 10 times a length of an opening of the frangible score long the public side of the center panel. The groove opening may be less than or equal to 6 times the width of the opening of the frangible score.

Another aspect of the invention is directed to a can end for a beverage container. The can end comprises: a circumferential curl positioned about a longitudinal axis; a wall extending downwardly from the curl; a strengthening member joined to the wall; and a center panel joined to the strengthening member and extending radially inwardly relative to the longitudinal axis. The center panel comprises: a product side; a public side; a rivet; a score line comprising a frangible score having terminal ends located on a common side of the rivet, the terminal ends separated by a non-frangible hinge segment; a displaceable tear panel in the center panel at least substantially defined by the frangible score and the non-frangible hinge segment; a non-detachable tab having a nose and a lift end wherein the nose overlays a portion of the displaceable tear panel; and a groove in the tear panel located adjacent the score line and generally following a contour thereof.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
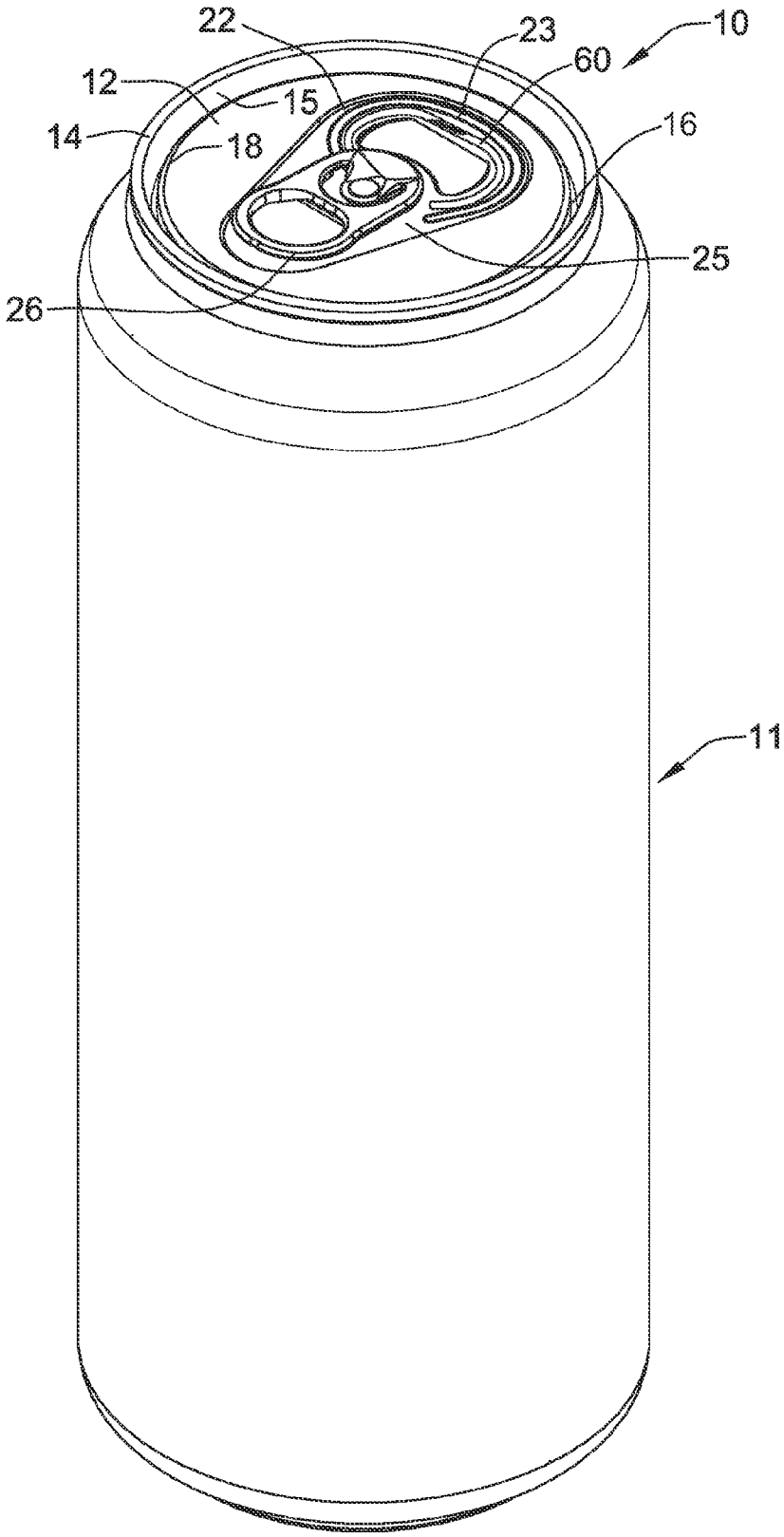
FIG. 1 is a perspective view of a beverage container including a can end of the present invention.
Figure 3:
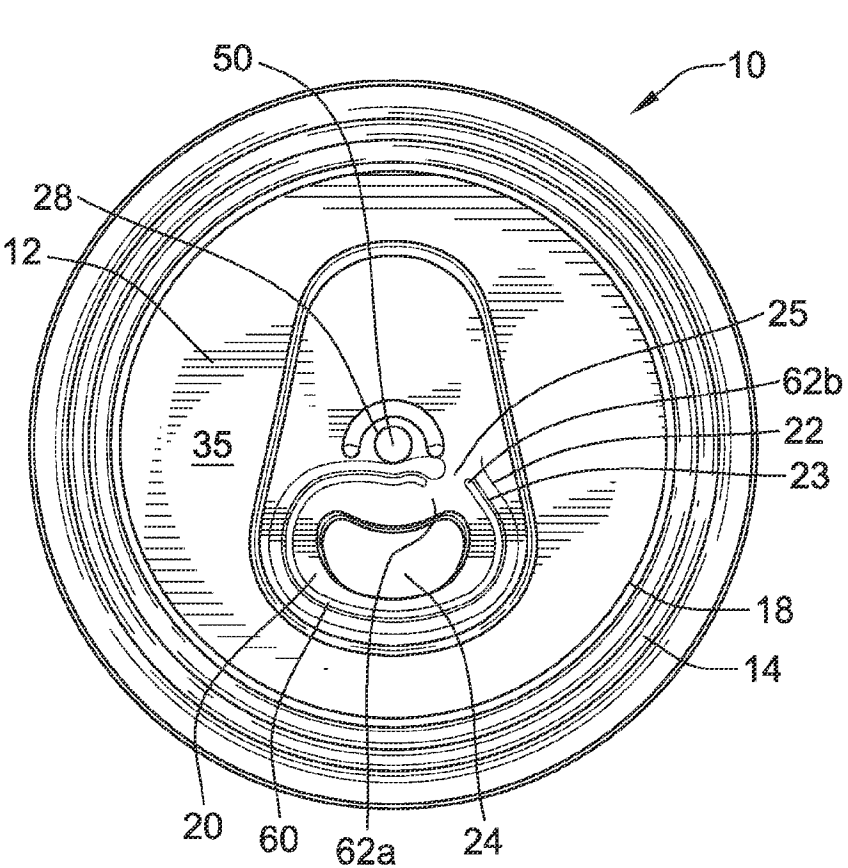
FIG. 3 is a bottom view showing the product side of the can end from the beverage container of FIG. 1.
Figure 2:
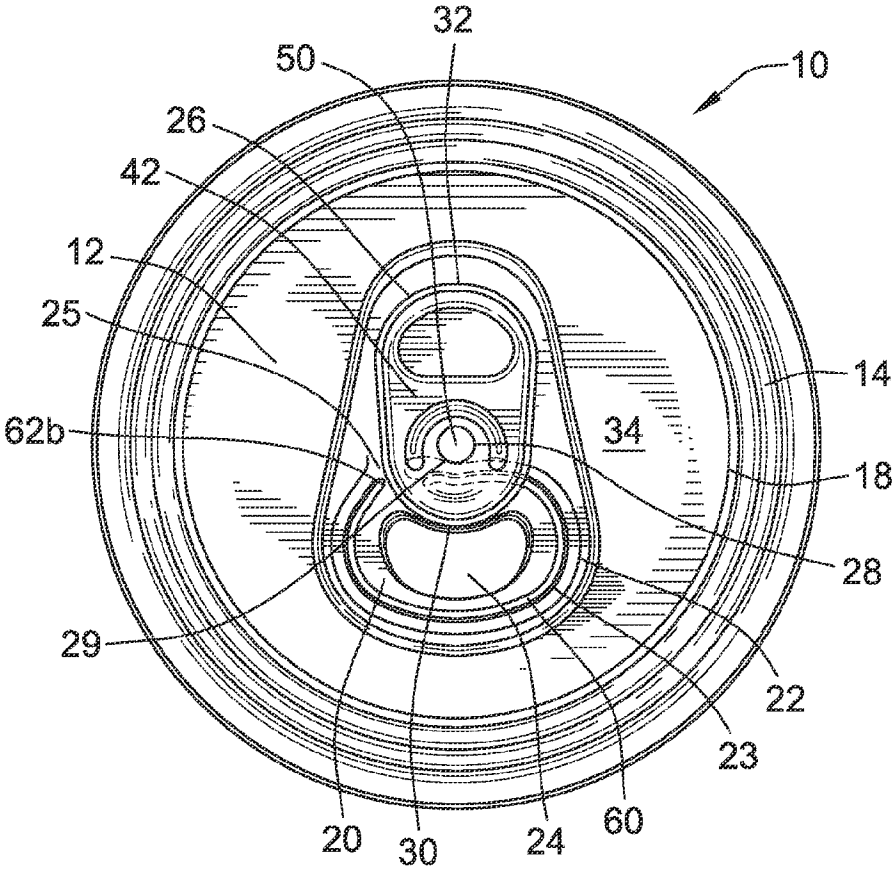
FIG. 2 is a top view showing the public side of the can end from the beverage container of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the figures, the end closure 10 for a container 11 has a central panel wall 12 having a seaming curl 14 for joining the end closure 10 to the container. The container 11 is typically a drawn and ironed metal can, usually constructed from a thin plate of aluminum or steel. End closures for such containers are also typically constructed from a cutedge of thin plate of aluminum or steel, formed into blank end, and manufactured into a finished end by a process often referred to as end conversion. In the embodiments shown in the figures, the central panel 12 is joined to a container by a seaming curl 14 which is joined to a mating curl of the container 11. The seaming curl 14 of the end closure 10 is integral with the central panel 12 by a downwardly extending wall 15 and a strengthening member 16, typically either a countersink or a fold such as those folds disclosed in commonly assigned U.S. Pat. No. 7,556,168, which is hereby incorporated by reference as if fully set forth herein for all purposes, but especially geometry and location of strengthening member folds, which is joined to the panel outer edge 18 of the central panel 12. This type of means for joining the central panel 12 to a container 11 is presently the typical means for joining used in the industry, and the structure described above is formed in the process of forming the blank end from a cutedge of metal plate, prior to the end conversion process. However, other means for joining the central panel 12 to a container 11 may be employed with the present invention.

The steps of manufacturing the end begin with blanking the cutedge, typically a round or non-round cutedge of thin metal plate. Examples of non-round cutedge blanks include elliptical cutedges, convoluted cut edges, and harmonic cut edges. A convoluted cutedge may be described as generally having three distinct diameters, each diameter being 45° relative to the others. The cutedge is then formed into a blank end by forming the seaming curl, countersink, panel radius and the central panel.

A means for opening the can end or accessing the contents of the container is typically formed in a conversion process for this type of end closure. This process includes the following steps: forming a rivet by first forming a projecting bubble in the center of the panel and subsequently working the metal of the bubble into a button and into the more narrow projection of metal being the rivet; forming the tear panel by scoring the metal of the panel wall; forming an inner bead or panel on the tear panel; forming a deboss panel by bending the metal of the panel wall such that a central area of the panel wall is slightly lower than the remaining panel wall; staking the tab to the rivet; and other subsequent operations such as wipe-down steps to remove sharp edges of the tab, lettering on the panel wall by scoring, incising, or embossing (or debossing), and optionally restriking the rivet island.

The central panel wall 12 is generally centered about a longitudinal axis 50 and has a displaceable tear panel 20 defined by a frangible score 22 and a non-frangible hinge segment 25. The tear panel 20 of the central panel 12 may be opened, that is the frangible score 22 may be severed and the tear panel 20 displaced at an angular orientation relative to the remaining portion of the central panel 12, while the tear panel 20 remains hinged to the central panel 12 through the hinge segment 25. In this opening operation, the tear panel 20 is displaced at an angular deflection. More specifically, the tear panel 20 is deflected at an angle relative to the plane of the panel 12, with the vortex of the angular displacement being the hinge segment 25.

The tear panel 20 is formed during the conversion process by a scoring operation and preferably has a surface area equal to or greater than 0.5 $in^2$ (3.23 $cm^2$), some smaller diameter ends have tear panels 20 less than 0.5 $in^2$ (3.23 $cm^2$). The tools for scoring the tear panel 20 in the central panel 12 include an upper die on a public side 34 having a scoring knife edge in the shape of the tear panel 20, and a lower die on a product side 35 to support the metal in the regions being scored. When the upper and lower dies are brought together, the metal of the panel wall 12 is scored between the dies. This results in the scoring knife edge being embedded into the metal of the panel wall 12, forming the score which appears as a wedge-shaped recess in the metal. The metal remaining below the wedge-shaped recess is the residual of the score 22. Therefore, the score 22 is formed by the scoring knife edge causing movement of metal, such that the imprint of the scoring knife edge is made in the public side 34 of the panel wall 12.

The tear panel 20 may also include an anti-fracture score 23. The anti-fracture score is generally located radially inwardly of the frangible score 22, except in the hinged region 25, and generally follows the contour of the frangible score 22. The anti-fracture score is provided to reduce residual stresses associated with the primary score line so as to prevent or minimize the occurrence of microcracks in, or premature fracture along, the frangible score line 22. Thus, a score line may include both the frangible score 22 and the anti-fracture score 23 in combination or, as will be described, solely the frangible score 22.

The tear panel 20 may further include a down panel 24. The down panel 24 forms a recessed segment between approximately 10 o'clock and 2 o'clock locations on the tear panel 20, using a clock-like orientation wherein a center of the clock-like orientation is defined by a central axis extending through a rivet 28 which is perpendicular to a transverse axis extending through a widest segment of the displaceable tear panel 20 and wherein a segment of the central axis defines a 12 o'clock to 6 o'clock distance. From the recessed segment toward the 6 o'clock position on the tear panel 20, the down panel 24 gently decreases in depth until it blends smoothly with adjacent areas of the tear panel 24 between approximately the 4 o'clock position clockwise to approximately the 8 o'clock position and remaining at least somewhat recessed from approximately the 8 o'clock position clockwise to approximately the 4 o'clock position.

The inventor is also aware of tear panels having circumferential up or convex beads and circumferential reverse, down, or concave beads.

The central panel 12 further includes a tab 26. The tab 26 has a generally elongated body with a central axis A-A defined by a central cross section through the tab nose 30, and through a central webbing 42 and the lift end 32. Typical prior art container ends often have a tab 26 which is staked in the final steps of the conversion process by staking the area of the panel wall 12 adjacent and under the rivet island at an angle, to bias the tab 26 such that the lift end 32 of the tab 26 rests close to the panel wall 12. The central panel 12 may also have a recess near the lift end 32 of the tab 26 to allow for easier finger access.

The opening of the tear panel 20 is operated by the tab 26 which is attached to the central panel 12 by the rivet 28, generally through a rivet hole 29. The tab 26 is attached to the central panel 12 such that the nose 30 of the tab 26 extends over a proximal portion of the tear panel 20. The lift end 32 of the tab 26 is located opposite the tab nose 30 and provides access for a user to lift the lift end 32, such as with the user's finger, to force the nose 30 against the proximal portion of the tear panel 20.

When the tab nose 30 is forced against the tear panel 20, the score 22 initially ruptures at the vent region of the score 22 of the tear panel 20. This initial rupture of the score 22 is primarily caused by the lifting force on the tab resulting in lifting of a central region of the center panel, immediately adjacent the rivet 28, which causes separation of the residual metal of the score 22. The force required to rupture the score in the vent region, typically referred to as the "pop" force, is a lower degree of force relative to the force required to propagate other regions of the score 22 by continued lifting of the lift end 32 of the tab 26. Therefore, it is preferable for the panel 12 in the area around the rivet 28 only lifts enough to assist with initial score rupture, or "pop," and remains substantially stiff and flat to provide the needed leverage for the tab 26 to propagate the scoreline of the tear panel 20. The present invention provides such optimal stiffness in the center panel, as is explained further below.

After the initial "pop", or venting of the tear panel, the user continues to lift the lift end 32 of the tab 26 which causes the tab nose 30 to be pushed downward on the tear panel 20 to continue the rupture of the score 22, as an opening force. As the opening operation is continued, the tear panel 20 is displaced downward and is rotated about the hinge region to be deflected into the container.

Figure 5:
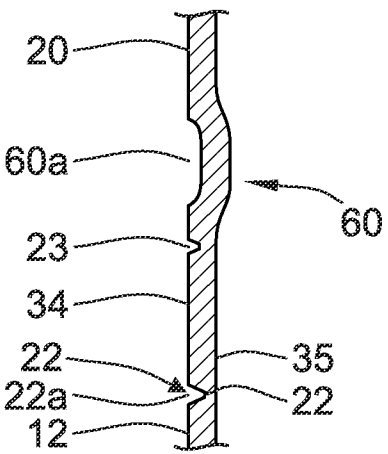
FIG. 5 is a magnified cross-sectional view of a score line segment showing a frangible score, an anti-fracture score and a deboss groove.
Figure 4:
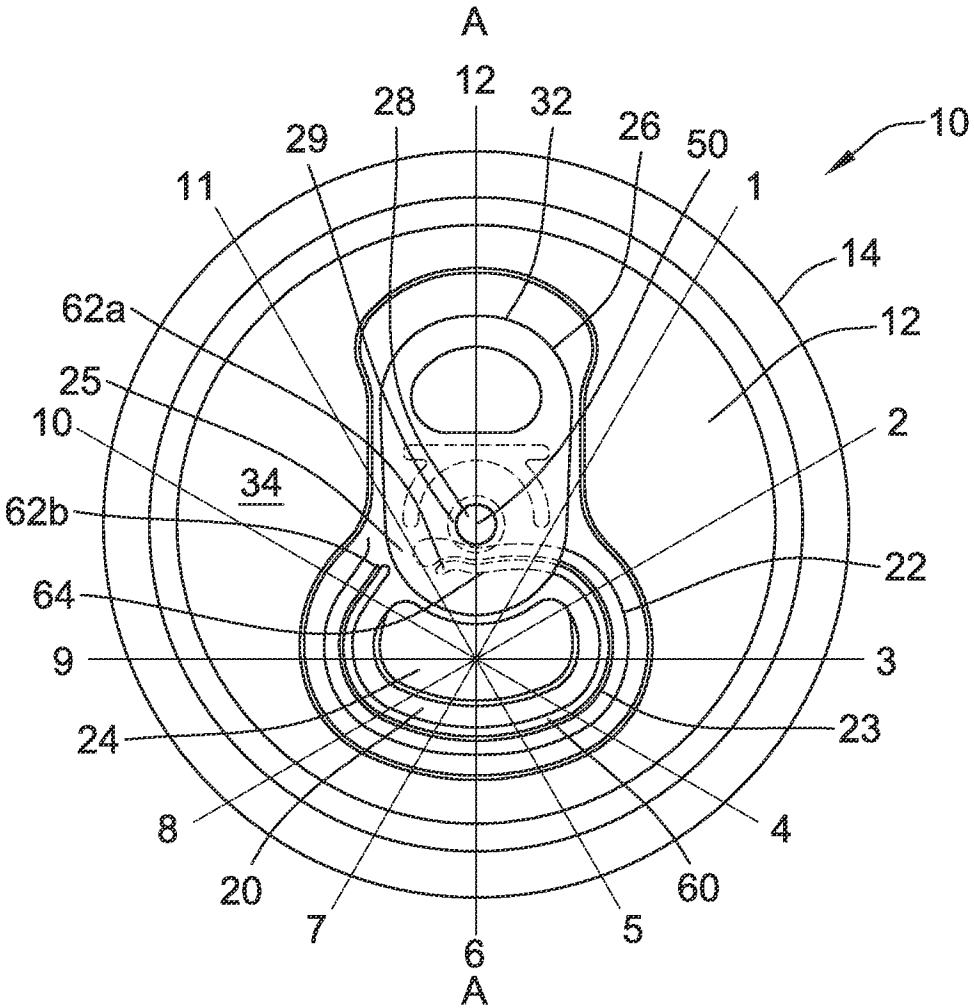
FIG. 4 is a top view of an alternative can end of the present invention.
Figure 6:
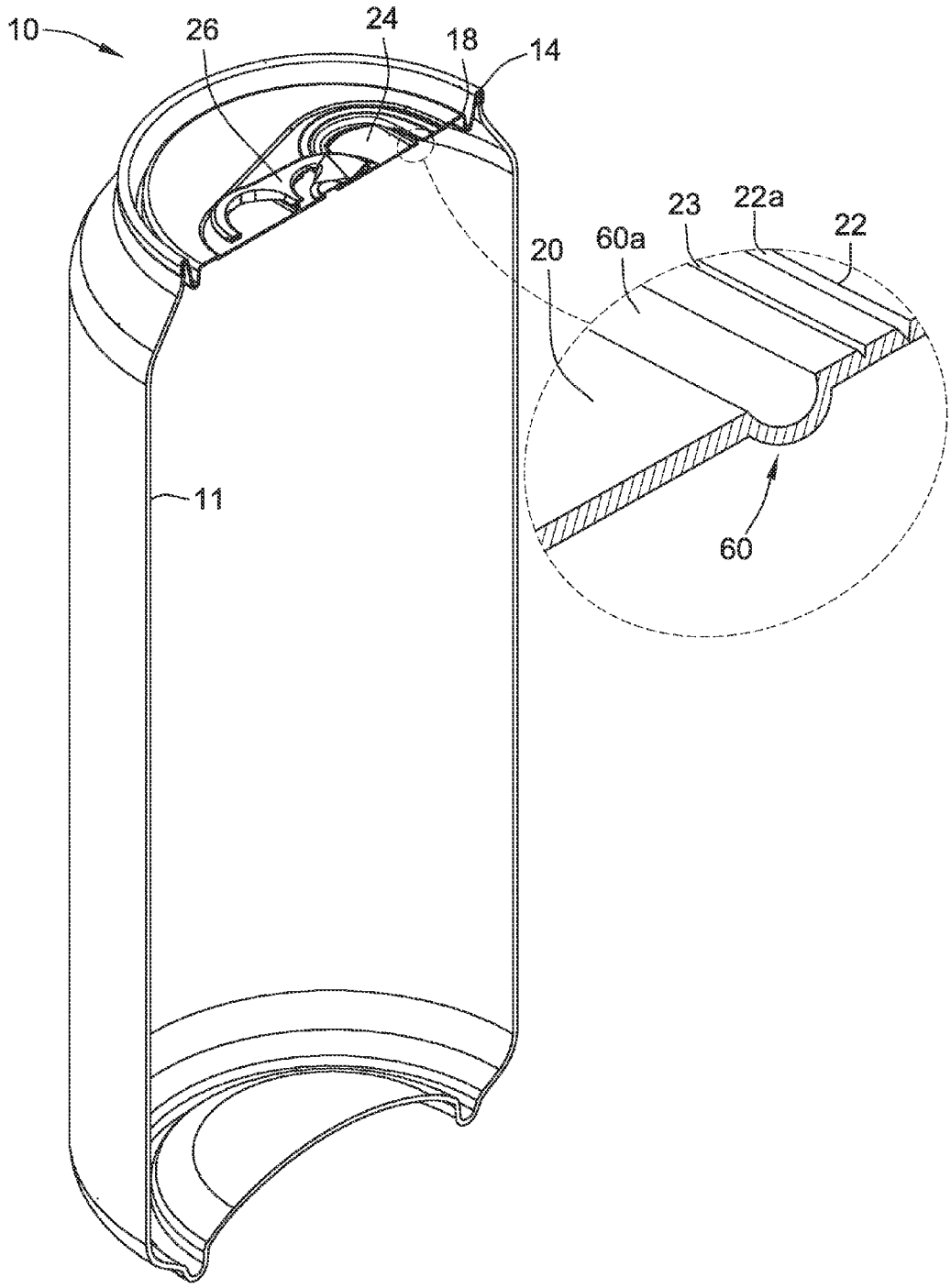
FIG. 6 is a cross-sectional view of a container with a magnified portion showing an anti-fracture score, a frangible score, and a recesses groove.

The tear panel 20 of the present invention further has a bead 60 adjacent its outer periphery. The bead 60 may be a convex bead, but is preferably a recessed groove which may also be called a narrow channel, preferably having a generally U-shaped cross-section. The groove 60 has a depth in magnitude that is almost up to the depth of the frangible score 22 (see FIG. 5). An opening 60*a* of the groove 60 has a width no more than 10 times a width of an opening 22*a* of the frangible score 22, preferably less than or equal to 6 times the width of the opening 22*a* of the frangible score 22. And, because the structure is a bead 60 rather than an incising, a score or a simple recess, the product side of the tear panel 20 exhibits a corresponding convex or concave bead as the case may be (see FIGS. 5 and 6).

The deboss groove 60 is located radially inwardly from the frangible score line 22 and may be located radially inwardly of the anti-fracture score 23 relative to the center point of the clock-like orientation. The groove 60 follows a contour of the score line and adjacent thereto. Unlike other known tear panel 20 relief features, the groove 60 lies very close to the score line, generally less than 7 mm from the score line, preferably less than 6 mm from the from the score line, more preferably less than 3 mm from the score line, and most preferably less than 1 mm from the score line, or range or combination of ranges therein. Accordingly, unlike other known tear panel relief features, the tab 26 overlies a portion of the groove 60 near the rivet 28, preferably just short of the 12 o'clock position, at about or just greater than the 11 o'clock position, to slightly greater than the 1 o'clock position, at about the 1:30 position.

The groove 60, like the score line 22, is non-circumferential. An interruption in groove 60 is located at the hinge area 25. Thus, the groove 60 has terminal ends 62*a*,62*b* located on opposite sides of the hinge area 25. One end 62*b* is located near an end of the frangible score 22, preferably terminating at a point just short of the end of the frangible score 22. Radially outwardly of the rivet 28, at approximately a 12 o'clock position, the groove 60 has a radially outward sloping portion 64 relative to the longitudinal axis 50, corresponding to a portion of the score line 22 adjacent the rivet 28.

The groove 60 is also preferably located between the score line 22 and any other tear panel feature, such as the down panel 24 or any other circumferential or non-circumferential emboss or deboss bead or panel. A distance between opposing sides of the deboss groove from a 9 o'clock to a 3 o'clock position on the displaceable tear panel 20 is greater than a distance between opposing edges of the non-detachable tab 26 taken along a line transecting the rivet 28 and parallel to the transverse axis.

More precisely, taken relative to the center of the clock-like orientation, the groove 60 has a short segment that extends radially inwardly from a position just short of the 12 o'clock position clockwise. The groove 60 extends radially outwardly until about the 2 o'clock position, at which point it curves downwardly and continuing radially outwardly to about the 3 o'clock position, at which point the groove 60 begins to extend radially inwardly. The curvature continues but at a larger radius of curvature from approximately the 4 o'clock to approximately the 8 o'clock position. From approximately the 6 o'clock position to approximately the 9 o'clock position the groove 60 curves radially outwardly. At about the 9 o'clock position, the groove 60 curves back towards the first end 62*a* of the groove 60, terminating before the hinge area 25. Thus, the groove 60 does not have a circumferential or 360° orientation. Instead, the groove 60 is preferentially non-circumferential, extending about 270°, preferably 300°, more preferably 340°, and most preferably 320°, or any range or combination of ranges therein.

Figure 7:
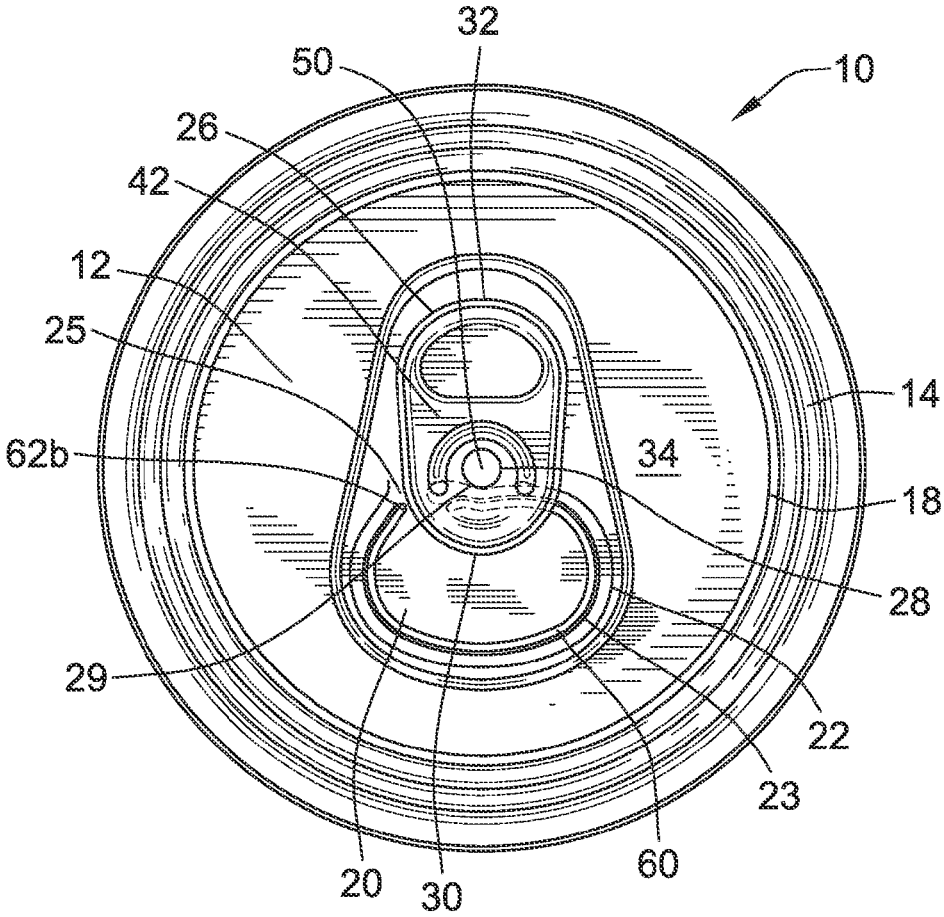
FIG. 7 is a top view of an alternative embodiment of the present invention having a generally flat central portion of the tear panel with the down panel eliminated resulting in improved stackability of a plurality of axially stacked can ends.

The groove 60 may complement the anti-fracture score line 23. The groove 60 is intended to relieve "pulling" against the frangible score 22. The groove 60 provides a tear panel 20 that is considerably stiffer over the previous pour panels 20. This is a significant improvement. The groove 60 also helps improve stackability of the can ends 10 because the groove 60 can also serve to eliminate the down panel 24, which may, in some instances, interfere with a portion of the tab 26 on the adjacent stacked end 10 (see, e.g. FIG. 7).

The invention also may allow a design feature (e.g. a pre-bend or a soft down panel) to interact with the stiffer pour panel.

The present invention may also eliminate the need for the anti-fracture score line 23. The groove 60 can be formed at the same time the frangible score 22 is made. One purpose of the anti-fracture score 23 is to control the movement of metal during scoring. When the frangible score 22 is formed, the metal quickly moves away from the scored area. If the metal moves too quickly, the can end may have fractures at the bottom corners of the main score 22. The moving metal causes the pour panel to bubble up when the end is scored. The anti-fracture score 23 controls and slows the movement of metal radially inwardly, because the metal cannot distort in that direction. The groove 60 allows more room for the metal to move, thus eliminating the need for the anti-fracture score 23.

The circumferential emboss bead generally gave way to a down panel on the center portion of the tear panel to further improve openability. The down panel was developed to lower the magnitude of the force required to open the tear panel, especially on LOEs. The down panel generally does not bulge or bulges less than other known types of tear panels. This keeps the score flat. When the score is flat, the pour panel does not have to pass back though the pour opening as the can end is opened. The down panel produced a concave effect upon initial opening. This allowed score on LOE's to shear easier or with less force.

The groove 60, or down line bead as it is sometime called, takes the loose metal from the base of the score 22 and tightens up or stiffens the end 10 to also improve openability. Additionally, an advantage of eliminating the anti-fracture score 23 is that it would help to keep the score area flatter. Typically, can ends have a frangible score 22 oriented at a slight angle. The groove 60 provides a flat area for the score 22. The flat score 22 causes less flexing of the score 22, and less premature failure or accidental opening of the tear panel 20. So, this invention will require less pressure to open the can.

The terms "first," "second," "upper," "lower," "top," "bottom," etc. are used for illustrative purposes relative to other elements only and are not intended to limit the embodiments in any way. The term "plurality" as used herein is intended to indicate any number greater than one, either disjunctively or conjunctively as necessary, up to an infinite number. The terms "joined," "attached," and "connected" as used herein are intended to put or bring two elements together so as to form a unit, and any number of elements, devices, fasteners, etc. may be provided between the joined or connected elements unless otherwise specified by the use of the term "directly" and/or supported by the drawings.

While the specific embodiments have been illustrated and described, numerous modifications come to mind without significantly departing from the spirit of the invention, and the scope of protection is only limited by the scope of the accompanying claims.

What is claimed is:

1. A can end for a container comprising:

a circumferential curl positioned about a longitudinal axis;

a wall extending downwardly from the curl;

a strengthening member joined to the wall; and a center panel joined to the strengthening member and extending radially inwardly relative to the longitudinal axis, the center panel comprising:

a product side;

a public side;

a rivet;

a score line comprising a frangible score having terminal ends located on a common side of the rivet, the terminal ends separated by a non-frangible hinge segment;

a displaceable tear panel in the center panel at least substantially defined by the frangible score and the non-frangible hinge segment;

a non-detachable tab having a nose and a lift end wherein the nose overlays a portion of the displaceable tear panel; and a deboss groove in the public side extending in a direction towards the product side and located adjacent the score line wherein the deboss groove is located radially inwardly from the score line and spaced no more than 3mm from the score line wherein the deboss groove follows a contour of the score line.

2. The can end of claim 1 wherein the deboss groove is non-circumferential.

3. The can end of claim 2 wherein the deboss groove is interrupted by a portion of the center panel located adjacent the non-frangible hinge segment.

4. The can end of claim 3 further comprising:

a down-panel in the displaceable tear panel wherein the deboss groove is located between the score line and the down panel.

5. The can end of claim 4 wherein the displaceable tear panel has a surface area greater than 0.5 $in^2$.

6. The can end of claim 5 wherein a distance between opposing sides of the deboss groove from a nine o'clock to a three o'clock position on the displaceable tear panel, using a clock-like orientation wherein a center of the clock-like orientation is defined by a central axis extending through the rivet which is perpendicular to a transverse axis extending through a widest segment of the displaceable tear panel and wherein a segment of the central axis defines a 12 o'clock to 6 o'clock distance, is greater than a distance between opposing edges of the non-detachable tab taken along a line transecting the rivet and parallel to the transverse axis.

7. The can end of claim 6 further comprising:

an anti-fracture score located radially inwardly of the frangible score.

8. The can end of claim 1 further comprising:

a down-panel in the displaceable tear panel wherein the deboss groove is located between the score line and the down panel.

9. The can end of claim 8 wherein the displaceable tear panel has a surface area greater than 0.5 $in^2$.

10. The can end of claim 9 wherein a distance between opposing sides of the deboss groove from a nine o'clock to a three o'clock position on the displaceable tear panel, using a clock-like orientation wherein a center of the clock-like orientation is defined by a central axis extending through the rivet which is perpendicular to a transverse axis extending through a widest segment of the displaceable tear panel and wherein a segment of the central axis defines a 12 o'clock to 6 o'clock distance, is greater than a distance between opposing edges of the non-detachable tab taken along a line transecting the rivet and parallel to the transverse axis.

11. The can end of claim 1 wherein the displaceable tear panel has a surface area greater than 0.5 $in^2$.

12. The can end of claim 1 wherein a distance between opposing sides of the deboss groove from a nine o'clock to a three o'clock position on the displaceable tear panel, using a clock-like orientation wherein a center of the clock-like orientation is defined by a central axis extending through the rivet which is perpendicular to a transverse axis extending through a widest segment of the displaceable tear panel and wherein a segment of the central axis defines a 12 o'clock to 6 o'clock distance, is greater than a distance between opposing edges of the non-detachable tab taken along a line transecting the rivet and parallel to the transverse axis.

13. The can end of claim 12 wherein the displaceable tear panel has a surface area greater than 0.5 $in^2$.

14. The can end of claim 1 wherein the deboss groove in the public side produces a corresponding convex groove relative to the product side.

15. A can end for a container comprising:

a circumferential curl positioned about a longitudinal axis;

a wall extending downwardly from the curl;

a strengthening member joined to the wall; and a center panel joined to the strengthening member and extending radially inwardly relative to the longitudinal axis, the center panel comprising:

a product side;

a public side;

a rivet;

a score line comprising a frangible score having terminal ends located on a common side of the rivet, the terminal ends separated by a non-frangible hinge segment;

a displaceable tear panel in the center panel at least substantially defined by the frangible score and the non-frangible hinge segment;

a non-detachable tab having a nose and a lift end wherein the nose overlays a portion of the displaceable tear panel; and a groove in the tear panel located adjacent the score line and said groove generally following a contour of the score line and having terminal ends located on opposite sides of the non-frangible hinge segment.

* * * * *